United States Patent [19]

Marega

[11] Patent Number: 4,802,290

[45] Date of Patent: Feb. 7, 1989

[54] CLAMPING DEVICE FOR SHOES AND BOOTS

[75] Inventor: Antonello Marega, Montebelluna, Italy

[73] Assignee: Calzaturificio Tecnica Spa, Treviso, Italy

[21] Appl. No.: 71,441

[22] Filed: Jul. 9, 1987

[30] Foreign Application Priority Data

Jul. 10, 1986 [IT] Italy ..... 22501/86[U]

[51] Int. Cl.[4] ..... A43B 5/04; A43C 11/00

[52] U.S. Cl. ..... 36/119; 36/50; 24/69 SK

[58] Field of Search ..... 36/117–121, 36/50, 88, 93; 24/68 SK, 69 SK, 70 SK, 71 SK

[56] References Cited

U.S. PATENT DOCUMENTS 4,192,087 3/1980 Salomon ..... 36/119
4,205,467 6/1980 Salomon ..... 36/119
4,682,426 7/1987 De Marchi ..... 36/50

FOREIGN PATENT DOCUMENTS 1238361 4/1967 Fed. Rep. of Germany ... 24/70 SK
3132042 5/1982 Fed. Rep. of Germany ..... 36/50
2576192 7/1986 France ..... 36/117

*Primary Examiner*—James Kee Chi
*Attorney, Agent, or Firm*—Armstrong, Nikaido, Marmelstein & Kubovcik

[57] ABSTRACT

In the case of shoes or boots, particularly a ski-boot, comprising an outer shell, an outer sole and an inner sole and, in the case of boots and ski-boots, an inner liner embracing the foot within the outer shell, the foot or the inner liner is clamped to the inner sole by means of a band-like member, two ends of which are connected, either directly or through flexible guys, to a clamping device, actuatable from the outside of the shoe or boot, and comprising a sleeve like member and a fixed anchoring member, to which members the said two ends of the band-like member are connected as stated, the sleeve-like member being slidable towards or away from said anchoring member by means of a cam lever, the position of said sleeve-like member being adjustable with respect to said anchoring member, by rotating said cam lever around the axis of sliding motion of said sleeve-like member.

11 Claims, 3 Drawing Sheets

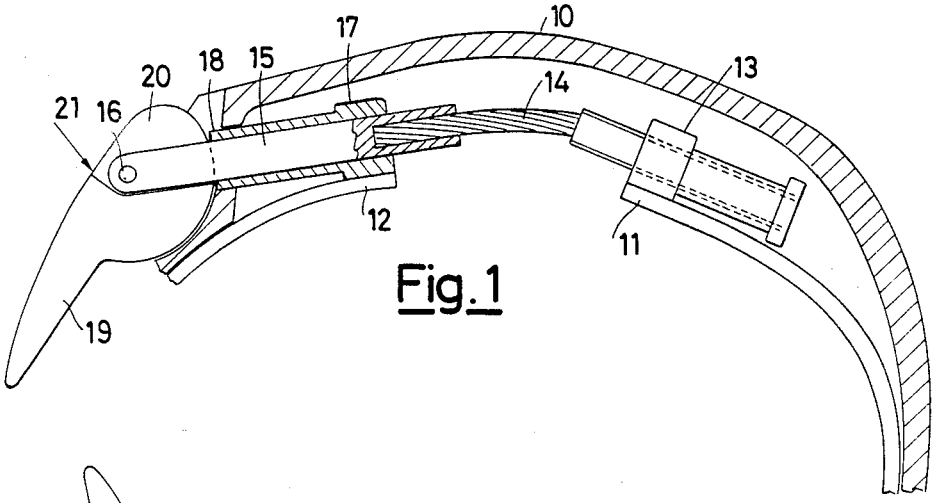
Fig. 1
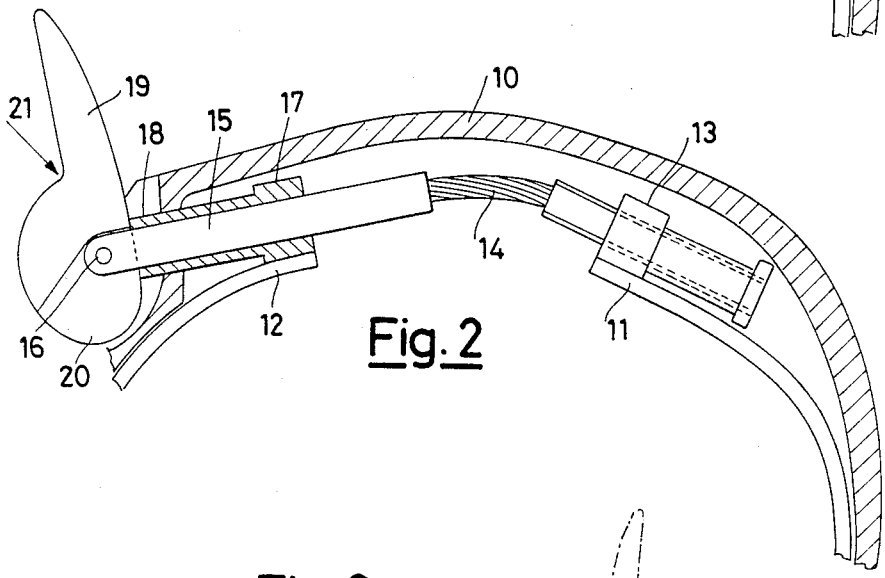
Fig. 2
Fig. 3
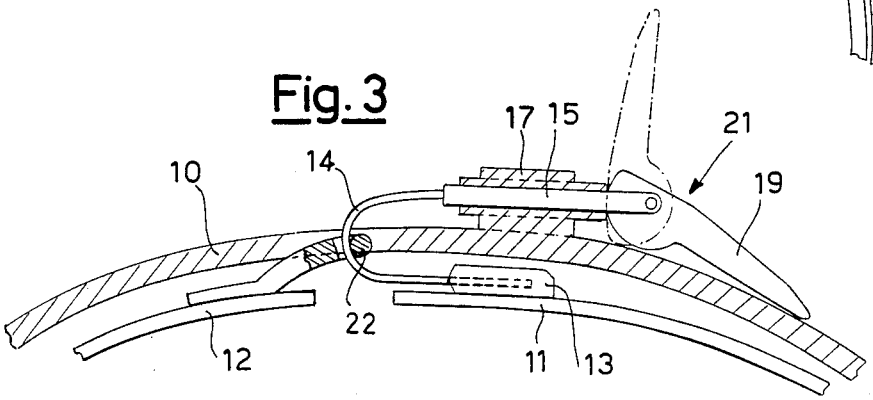

CLAMPING DEVICE FOR SHOES AND BOOTS

The present invention relates to a clamping device for shoes and boots, particularly ski-boots.

Hereinafter specific reference shall be made to the ski-boots, it having exclusively illustrative purpose, without anyhow limiting the scope of the invention.

Modern ski-boots normaly comprise a rigid outer shell of plastic material, having an outer sole and a boot leg, pivotally connected to the outer shell and openable for the introduction of the foot.

Within the outer shell an inner liner is housed, suitably padded, receiving and embracing the foot.

In recent years, especially for the "rear entry" ski-boots, there have been proposed and produced devices for the clamping of the inner liner to to the shell, in order to improve the transmission of the movements of the leg to the ski, and thus the skier's control of the skis.

Some solutions provide for the use of bands or half-bands embracing the inner liner within the shell and which must be tightened at the time of the clamping.

It is evident that the control elements of such a clamping or tightening device must be positioned outside of the shell or be anyhow readily accessible, since such a clamping must be effected with the ski-boot put on.

The main purpose of the present invention is that of providing a clamping device of simple and unfailing operation, the control of which is positioned outside of the shell of the boot.

A more specific purpose is that of providing a device of the aforesaid type providing a fast clamping and unclamping control and the possibility of a fine adjustment of the clamping degree.

These purposes are achieved by means of a clamping device for band-like members or for the adjacent edges of half-band members, which, according to a first embodiment of the invention, comprises a first anchoring member connected to a first edge, a guy member, preferably flexible, having a first end permanently fastened to said first anchoring member and the second end anchored to the pivoting point of a control lever, a sleeve member fixed to the other of said edges to be clamped, said sleeve member being axially freely slidable with respect to said guy and being into engagement with a cam rigidly connected to said control lever, the latter being movable between two positions, respectively of clamping and unclamping, in the first of which said cam presses against said sleeve member causing it to slide along said guy towards said anchoring member, whereas in the second position, namely that of unclamping, said sleeve member is disengaged from said cam and acted on by an elastic force to slide along said guy in the direction away from said anchoring member, and means for the adjustment of the length of said flexible member between said anchoring member and said control lever.

According to a second embodiment of the clamping device of the present invention, said guy member is a rigid rod-like member, having a externally screw threaded part, into engagement with the threaded internal surface of a hole formed in said anchoring member, the said rod like member being slidably housed into the said sleeve-like member, having screw threaded outer surface of opposite hand with respect to that of outer surface of said rod-like member, the sleeve-like member being engaged by a second anchoring member and being fastened to a fixed U-shaped bracket, the sides of the U of which are fastened to the pivoting axis of said control lever, said rod-like member protruding through a hole, axially aligned with said hole of said sleeve-like member, and having at the protruding end a bearing surface which is engaged by said cam when the control lever is moved towards the clamping position, whereby the engagement of the cam with said bearing surface causes said rod-like member to be pushed, together with said first anchoring member, away from said second anchoring member, said lever being rotatable around the axis of said rod-like member, whereby, depending on its rotation direction, said two anchoring members are moved either towards each other or away from each other owing to their engagement with the outer threaded surface of the rod-like member and with the externally threaded surface of said sleeve member, connecting means being provided between the rod-like member and the sleeve-like member permitting the relative sliding motion but not the rotation of the former with respect to the latter, whereby the rotation of the control lever causes the sleeve-like member to rotate around its axial axis and the rod-like member also to rotate around its axial axis.

The peculiar features and advantages of the present invention shall more clearly appear from the following detailed description, made with reference to the enclosed drawings, illustrating schematically and as cross-section views, the preferred embodiments of the invention.

More particularly:

FIG. 1 shows the clamping device of the invention in the clamping condiction;

FIG. 2 is like FIG. 1, but showing the device in the unclamping condition;

FIG. 3 shows a different form of device of the fig.1, and

Figure 4:
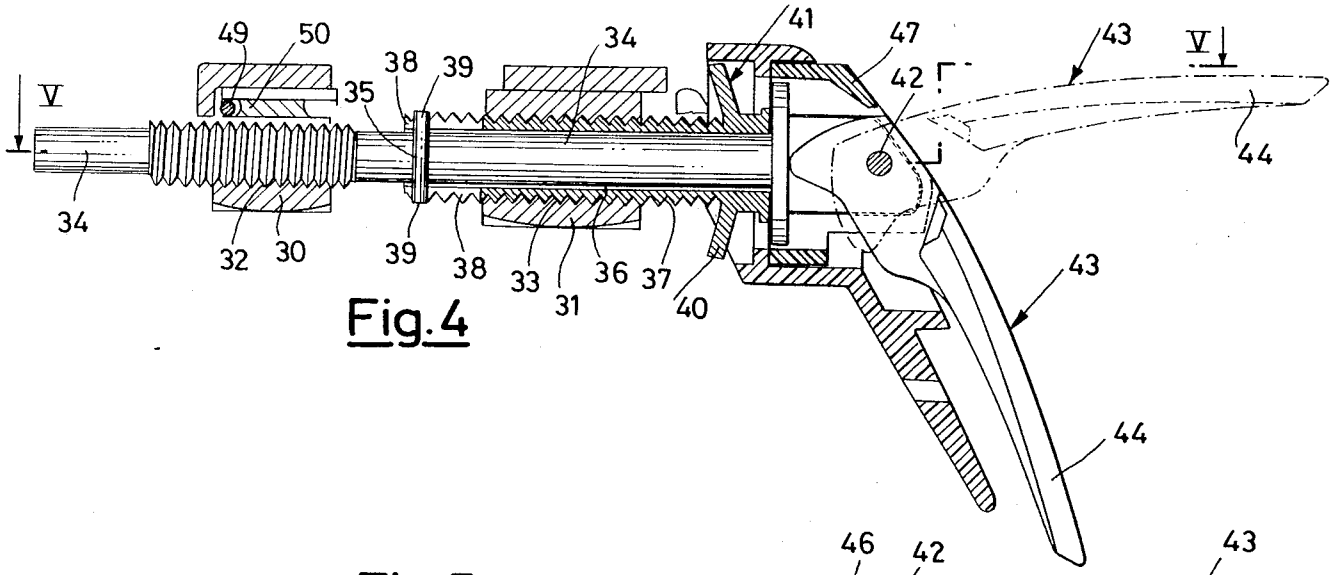
FIG. 4 is a view like FIG. 3 of a further embodiment of the invention.

Referring firstly to FIGS. 1 and 2, it is to be noted that, for sake of simplicity and clarity of illustration, the whole ski-boot is not shown, but only a portion thereof. The only important point is that the clamping device of the invention is preferably positioned at the front part of the shell of the ski-boot, normally the part corresponding to the dorsum of the foot beneath the malleolus articulation.

Reference 10 indicates the rigid shell of the ski-boot, particularly the upper thereof, whereas the reference numbers 11 and 12 show the edges of two half-band members, adjacent but separated from each other, the two half-band members being for instance of a suitable plastic material, such as flexible polyvinylchloride, having some intrinsic elasticity. To the edge 11 there is fastened a permanent anchoring member 13, in the form of a clamp to which the end of a guy 14 is fastened, the guy 14 being for instance in form of a cable formed by braided wires, whereas the other end is fastened to a tie bar 15, having the opposite end pivotally fixed to the pin 16.

A sleeve member 17 is rigidly fastened to the edge 12, the sleeve 17 being freely coaxially slidable along the tie bar 15, the sleeve 17 having furthermore the end 18 slidably housed in a hole or opening formed in the shell 10.

A lever 21, comprising an actuating handle 19 and a cam shaped part 20, is journalled to the pin 16, the latter being fixed to the shell 10.

The lever 21 is movable between two positions, respectively of closing and clamping (shown in fig.1) and opening and unclamping (shown in fig.2).

In the closing and clamping position of the lever 21, the cam part 20 presses against the end 18 of the sleeve 17, pushing it together with the related edge 12 towards the adjacent edge 11, such a displacement being possible owing to the sliding motion of the sleeve 17 along the tie bar 15.

By raising the handle 19 from the closing position to the opening one, the quick unclamping of the two edges 11 and 12 is obtained, since the end 18 of the sleeve 17 is no longer engaged by the cam part 20 of the lever 21. Such an unclamping is obviously helped by the elasticity of the two edges 12 and 11, but an auxiliary spring might be provided, interposed between the sleeve 17 and the clamp 13.

In order to obtain a fine adjustment of the clamping action, by adapting it for example to the foot and thus to the inner liner to be tightened and clamped, it is enough to rotate the handle 19 around its axis so as to have end of the guy 14 entered more or less within the clamp 13 and thus its length from the pivoting axis 16 of the lever 21 to the clamp 13 adjusted: consequently upon the lever 21 being actuated the tightening and clamping force of the two edges 11, 12 shall be correspondingly varied.

In the embodiment of fig.3, a ring 22 is fastened to the edge 12, a guy rope or cable 14 passing through the ring, whereas the sleeve 17 is directly secured to the shell 10; from the figure the operation of this embodiment is readily understood, both as regards the clamping and unclamping, and as regards the adjustement of the tightening force.

Figure 5:
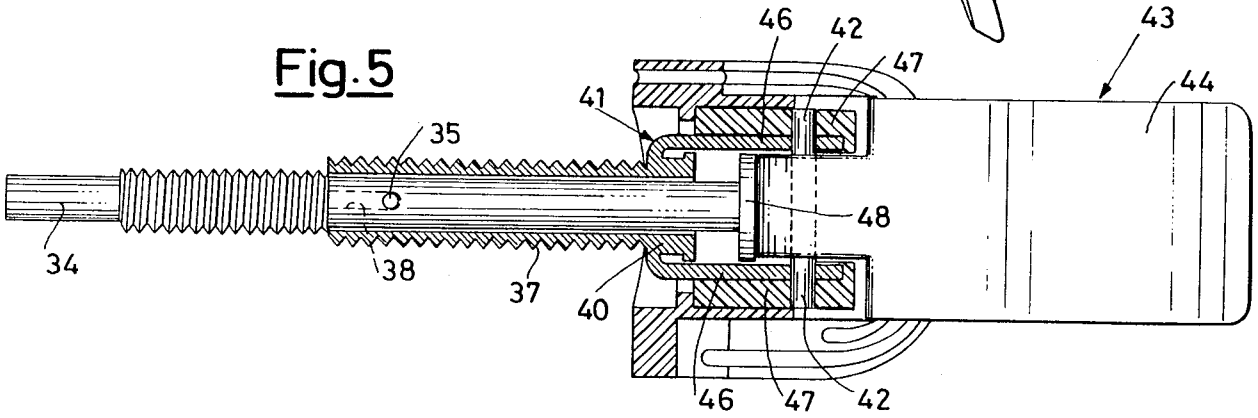
FIG. 5 is a cross-section view taken along the traces V—V of FIG.4.
Figure 6:
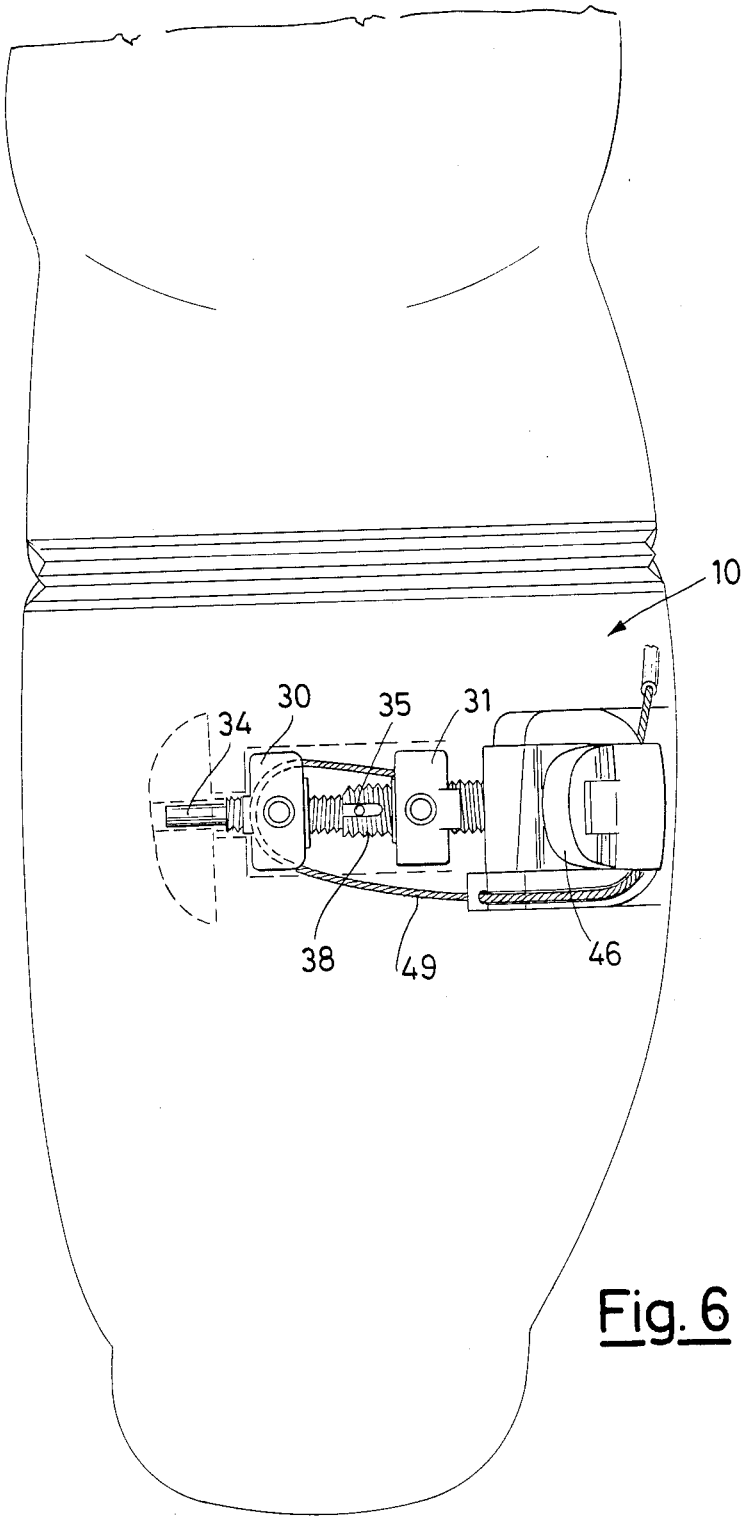
FIG. 6 is a plan view from above of the embodiment of figs. 4 and 5, with part of the related ski-boot.

Referring now to the embodiment shown in the FIGS. 4 and 5, it relates to the case in which a band-like member must be tightened against the foot or the inner liner, this band like member being not shown, but having its ends connected to the two anchoring members 30 and 31, each having an axial screw threaded hole, 32 and 33 respecttively.

A tie bar 34, externally screw threaded, is threadedly engaged with the hole 32.

One end of the tie bar 34 is provided with a radially protruding pin 35 and is slidably engaged with the axial hole 36 of a sleeve-like member 37, bearing an external screw thread engaged with the internal screw thread of the hole 33 of the anchoring member 31.

The screw threads of the tie bar 34 and of the sleeve member 37 are of opposite hands, whereby the rotation of the sleeve member 37 and of the tie bar 34 causes the anchoring members 30 and 31 to be displaced either towards or away from each other depending on the rotation direction.

The sleeve member 37 is provided with two radially aligned slots 38, wherein the protruding ends 39 of the pin 35 are slidably housed, thus permitting a relative sliding displacement of the tie bar 34 with respect to the sleeve but not the rotation of the tie bar 34 independently of the sleeve 37.

The other end of the sleeve member 37 is rigidly connected to the base plate 40 af an U-shaped bracked 41, the two sides 46 of which are fixed to the cross pin 42, forming the pivoting axis of the control lever 43 provided with a handle 44 and a cam portion 45 integrally formed therewith.

The shell 10 of the boot is provided with a circular seat in which a plastic block is rotatably housed, this plastic block comprising two side shoulders 47 between which the cross pin 42 is mounted, the sides of the bracket 41 being positioned parallel to said shoulders and being fixed thereto, whereby the rotation of the said block causes also the bracket 41 and the cross pin 42 to rotate around the axis of said seat, said axis being aligned with the longitudinal axis of the sleeve 37 and of the tie bar 34.

The handle 44 is journalled to the cross pin 42 and is actuatable between the two positions shown in FIG. 4, namely that of clamping shown in full lines and that of unclamping shown in dashed lines; the rear portion of the lever 43, likewise the embodiments shown in the FIGS. 1 to 3, is cam shaped and, in correspondence to the two positions of the handle 44, takes two positions, by passing within the block below the cross pin 42 and between the two shoulders 47.

The base plate 40 of the bracket 41 is provided with a center hole, through which the end of the tie-bar 34 passes, terminating with an enlarged head 48, preventing the tie bar 34 from coming out through the center hole of the plate 40 and through the sleeve 37.

This head 48 is acted upon by the cam part of the lever 43, i.e., when the handle 44 is rotated around the cross pin 42 to the clamping position, the cam part of the lever 43 presses against the head 48 of the tie bar 34, the latter being thus pushed towards the position of maximum extension out of the sleeve 34.

When, on the contrary, the handle 44 is rotated towards the unclamping position, the cam part does no longer press against the head 48 and consequently the tie bar 34 may reenter, for the maximum length given by the axial extension of the slots 38, into the sleeve member 37, whereby the anchoring member 32 is brought towards the other anchoring member 31.

This displacement of the tie bar 34 is helped by the elasticity of the band member to be tightened against the foot or the inner liner, as well as by the reaction of the foot against the said band member.

In the shown embodiment one end of the band member is fixedly fastened to the shell of the boot, whereas the other end is fixed by means of the braided wire 49 to the anchoring member 31, the wire 49 passing into a seat 50 formed in the anchoring member 30.

Consequently the actuation of the lever 43 causes the anchoring member 30 to be displaced away from the anchoring member 31, whereby the wire 49 is tensioned and this tension is transmitted along the braided wire to the corresponding end of the band-like member.

The advantages of the device of the invention are evident since the clamping and unclamping of the foot to the boot are achieved with a quick and easy manoeuver.

Quick and efficacious as well is the adjustment of the clamping force. Lastly a further important advantage is that the control lever can be thus positioned in the upper and front part of the shell of the boot. As already mentioned, the device of the present invention is identically applicable also to other types of working and sport shoes, such as working boots, skating shoes, climbing shoes, motorcycle boots and the like. Lastly it is understood that modifications and changes conceptually and mechanically equivalent are possible and foreseable without coming out the scope of the invention.

I claim:

1. Clamping device for band-like members in shoes and boots in which a foot is releasably clamped to the shoe, said device comprising:

a control lever located at an outer surface of the shoe, said lever being pivotally actuatable between a lever clamping position and a lever unclamping position;

a cam part rigidly connected to said lever and actuatable with said lever between a first clamping position and a second unclamping position;

an anchoring member connected to an edge to be clamped, said anchoring member being adjustably connected to one end of a guy member, the other end of said guy member being engagable with said cam part when in said first clamping position;

a sleeve member freely axially slidable along said guy member and connected to a second edge to be clamped, whereby actuation of said control lever to said lever clamping position causes said cam part to be actuated towards said first clamping position, said cam part engaging said sleeve member to cause a relative sliding motion between said guy member and said sleeve to bring said second edge towards said first edge.

2. Clamping device for band-like members in shoes and boots in which a foot is releasably clamped to the shoe, said device comprising:

a control lever located at an outer surface of the shoe, said lever being pivotally actuatable about a pivoting point between a lever clamping position and a lever unclamping position;

a cam part rigidly connected to said lever and actuatable with said lever between a first clamping position and a second unclamping position;

an anchoring member rigidly connected to a first edge to be clamped to a second edge;

a guy member having a first and second end, said first end being permanently and adjustably anchored to said anchoring member, said second end being anchored to said pivoting point of said control lever;

a clamping member fastened to said second edge to be clamped;

a sleeve-like member mounted for relative free sliding motion with respect to said guy member, said sleeve-like member being engageable with said cam part, said cam part pressing against said sleeve-like member when said control lever is in said lever clamping position causing said relative sliding motion to bring said edges toward each other, said cam part and said sleeve-like member being disengaged when said control lever is in said lever unclamping position and said edges are urged away from each other by said relative sliding motion under an elastic force;

adjustment means for adjusting the length a said guy member between said anchoring member and said control lever.

3. Clamping device according to claim 2, wherein said guy member is flexible.

4. Clamping device according to claim 3, wherein said guy member is a cable of braided wires.

5. Clamping device according to claim 3, wherein said sleeve-like member is directly fastened to said second edge and is freely slidable along said guy member.

6. Clamping device according to claim 5, wherein said guy member includes a rigid bar at a portion engageable with said sleeve-like member.

7. Clamping device according to claim 3, wherein said adjustment means comprises a threaded engagement between said first end of said guy member and a threaded axial hole formed inside anchoring member.

8. Clamping device for band-like members in shoes and boots in which a foot is releasably clamped to the shoe, said device comprising:

a control lever located at an outer surface of the shoe, said lever being pivotally actuatable about a pivoting axis between a lever clamping position and a lever unclamping position;

a cam part rigidly connected to said lever and actuatable with said lever between a first clamping position and a second unclamping position;

first and second anchoring members each fastened to an edge to be clamped, each said first and second anchoring member having a threaded axial hole;

a guy member having a first and second end said first end being a externally threaded tie bar having an axis, said tie bar being threadably engageable with said threaded axial hole of said first anchoring member;

an externally threaded sleeve member rigidly connected to a U-shaped bracket, said sleeve member having an axis and being threadably engageable with said threaded hole of said second anchoring member, said U-shaped bracket having sides and a base plate, said sides being fixed to said pivoting axis of said control lever, said base plate having a hole, said tie bar protruding through said hole, said tie bar having a head for preventing said tie bar from coming out of said hole, said cam part acting upon said head of said tie bar when said cam part is brought into said first clamping position by said control lever, thereby axially displacing said tie bar with respect to said sleeve member;

pin and slot connecting means provided between said tie bar and said sleeve member for preventing independent rotation of said tie bar with respect to said sleeve member.

9. Clamping device according to claim 8, wherein said control lever is pivotally mounted to a cross pin mounted between two shoulders protruding, together with said sides of said U-shaped bracket, from a base block rotatable housed on a seat provided in a shell of said boot, whereby, when said lever is in said lever unclamping position, rotation is permitted of said control lever, together with said block, said bracket, said sleeve member and said tie bar around said axis of said tie bar and of said sleeve member.

10. Clamping device according to claim 8, wherein said external threads of said tie bar and said sleeve member are of opposite hands, whereby rotation of said control lever around said axis of said tie bar causes said first and second anchoring members to be simultaneously brought towards or away from each other.

11. Clamping device according to claim 8, wherein said second anchoring member is connected to one edge of a band-like member by means of a flexible braided wire passing around said first anchoring member, whereby actuation of said control lever causes said first and second anchoring members to be moved away from each other thereby tensioning said braided wire, the other end of said band-like member being fastened to a fixed point of a shell of a boot.

* * * * *